United States Patent [19]

Duncan

[11] Patent Number: 4,612,947

[45] Date of Patent: Sep. 23, 1986

[54] APPARATUS FOR REMOVING SOIL FROM THE WASH AND RINSE WATERS OF AN AUTOMATIC DISHWASHER

[75] Inventor: Thomas W. Duncan, Connersville, Ind.

[73] Assignee: Design & Manufacturing Corporation, Connersville, Ind.

[21] Appl. No.: 739,975

[22] Filed: May 31, 1985

[51] Int. Cl.[4] ..... B08B 3/02

[52] U.S. Cl. ..... 134/104; 134/109; 134/186; 210/136; 210/167; 241/46 R

[58] Field of Search ..... 134/104, 109, 111, 174, 134/176, 186, 188, 191, 193, 195; 68/18 F, 18 D, 184; 210/136, 167; 241/46 R

[56] References Cited

U.S. PATENT DOCUMENTS

| | | | |
|---|---|---|---|
| 3,253,784 | 5/1966 | Long et al. | 134/176 X |
| 4,150,680 | 4/1979 | Johnson et al. | 134/104 |
| 4,168,715 | 9/1979 | Spiegel et al. | 134/104 |
| 4,243,431 | 1/1981 | Dingler et al. | 134/186 X |
| 4,319,599 | 3/1982 | Dingler et al. | 134/104 X |
| 4,392,891 | 7/1983 | Meyers | 134/104 X |

*Primary Examiner*—Philip R. Coe
*Attorney, Agent, or Firm*—Frost & Jacobs

[57] ABSTRACT

A food soil separation apparatus for cleaning the wash and rinse waters of an automatic dishwasher. The apparatus comprises a reversible motor and a lower pump housing with a lower impeller surmounted by an upper pump housing with an upper impeller. The lower and upper impellers are connected to the motor shaft and are driven in one direction during a wash or rinse operation and in the other direction during a drain operation. An annular separation chamber surrounds and defines the upper pump housing. The lower pump housing has a pump cavity containing the lower impeller and having a first passage connected to spray devices in the dishwasher vat, a second passage connected to a check valve-controlled wash and rinse water inlet tube extending into the separation chamber, and a third passage connected to a drain water inlet tube extending into the separation chamber. The separation chamber has an outlet tube connected to drain. During wash and rinse operations, a majority of the water entering the lower pump housing cavity passes through the first outlet with a lesser amount entering the second outlet and the wash and rinse water inlet to the separation chamber, wherein food soils precipitate therefrom. The supernatant wash or rinse water is returned from the separation chamber to the vat. During a drain operation, water from the lower pump housing cavity enters the third passage and the drain water inlet tube to the separation chamber, exiting the separation chamber via its outlet tube to drain, and carrying the precipitated food soil with it.

19 Claims, 30 Drawing Figures

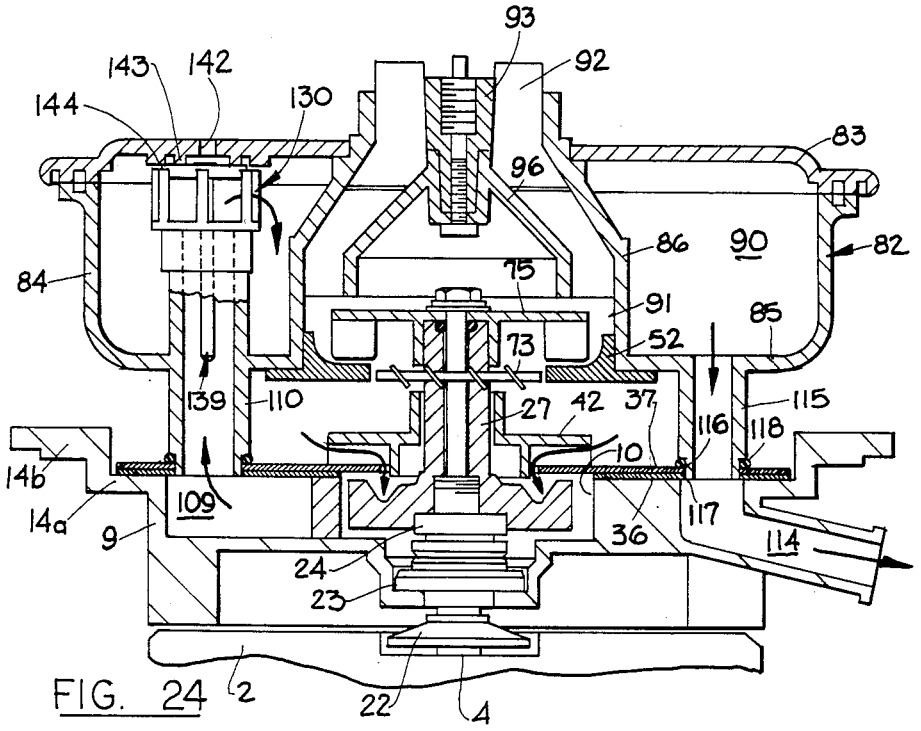
FIG. 24
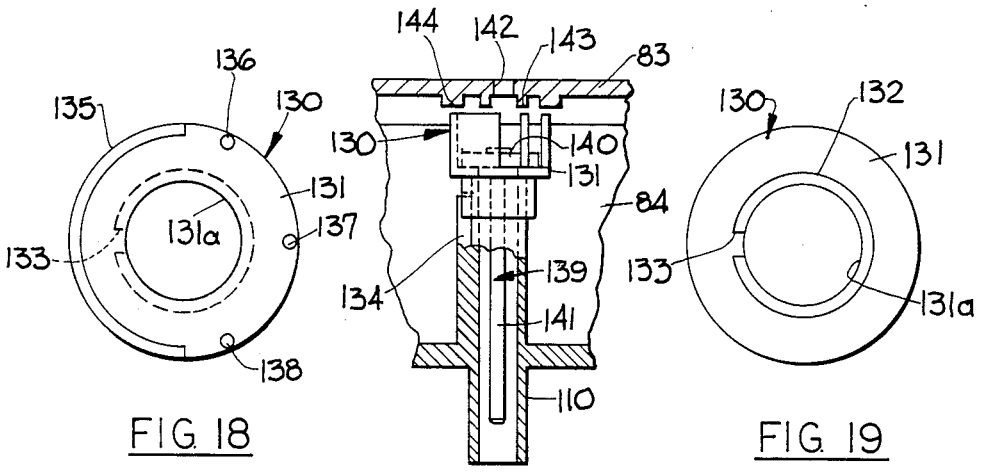
FIG. 18
FIG. 19
FIG. 20

APPARATUS FOR REMOVING SOIL FROM THE WASH AND RINSE WATERS OF AN AUTOMATIC DISHWASHER

TECHNICAL FIELD

The invention relates to apparatus for separating food soils from the wash and rinse waters of an automatic dishwasher during the wash and rinse operations of its cycles, the food soils being retained by the apparatus until discharged directly to drain during the drain operations of the dishwasher cycles. More particularly, the invention relates to such apparatus which is extremely simple in design and operation, highly effective, and fully automatic.

BACKGROUND ART

While the broad concept of separating food soils from the wash and rinse waters of dishwashing machines is abundantly old, as exemplified by U.S. Pat. No. 1,971,588, in recent years there has been renewed interest in this concept. By collecting food soil particles during the washing and rinsing operations of a dishwasher cycle, as they are removed from the tableware, redeposition of these particles on the tableware being cleaned is minimized. The net result of this action is earlier removal of the soil from the tableware, thus allowing the tableware to be cleaned with fewer water changes. If the number of water changes is not reduced, a higher degree of cleaniness is achieved.

Many approaches have been taken by prior art workers. Soil separation primarily by centrifugal action is relied upon in the teachings of the above noted U.S. Pat. No. 1,971,588. Prior art workers have also tried various types of screens and filter means through which the wash and rinse waters pass. It has been found, however, that particles of starchy foods and fibrous foods tend to stick to screens and filters, clogging them, and requiring the operator to remove and manually clean them frequently. An exemplary system using filters or screens is taught in U.S. Pat. No. 3,989,054. Sometimes special water jets or the like are employed to clean the screens, as is taught, for example, in U.S. Pat. No. 4,392,891.

It has been found that in order for a food soil separator to be beneficial to the operator, it must be of such configuration that the sticky soils are thoroughly removed automatically, and without any special attention or manipulative steps by the operator. Prior art workers, therefore, directed their attention away from screens and filters to other types of devices for separating the food soils. One such device is the sedimentation or separation chamber. According to this approach, a portion of the washing fluid or rinsing fluid is directed into a chamber and allowed to circulate therethrough at a low enough velocity to allow the particulate food soil to precipitate before the supernatant fluid is returned to the washing chamber. The use of such a chamber has a number of advantages. First of all, the passages are necessarily large and there are no screens to clog. In addition, the collected food soil can easily and thoroughly be disposed of directly to the drain when the dishwashing machine cycle advances to the drain operation. U.S. Pat. Nos. 4,150,680; 4,168,715 and 4,243,431 are exemplary of prior art soil separating apparatus utilizing both centrifugal separation and a soil separation chamber. The structures of these references utilize uni-directional pump motors causing the cleansed wash and rinse waters to be recirculated in the dishwasher chamber or vat. During the drain operation of the dishwasher cycle, collected soils from the chamber exit to the drain through an openable and closable valve means.

U.S. Pat. No. 4,319,599 teaches a soil separator utilizing both centrifugal force and a soil separating chamber. The apparatus of this patent employs a reversible motor which operates both a recirculation impeller and a drain pump impeller. The reference device also employs an annular wall means forming a guide chamber in fluid communication with the recirculating pump chamber and the separation chamber. The separation chamber is provided with a pressure-actuated valve which opens during the drain operation of the dishwasher cycle.

The present invention is directed to apparatus for removing food soil from the wash and rinse waters of an automatic dishwasher, of the type employing a separation chamber. The apparatus of the present invention is highly effective and fully automatic, requiring no special attention or manipulation by the operator. Unlike prior art structures, the apparatus of the present invention is characterized by an unique simplicity of design and operation. The device employs a bi-directional motor. The separation chamber contains at least one valve in the form of a simple check valve operated by the dishwasher fluid, itself.

DISCLOSURE OF THE INVENTION

According to the invention there is provided a food soil separation apparatus for cleansing the wash and rinse waters of an automatic dishwasher. The apparatus comprises a reversible motor, a lower pump housing and an upper pump housing, with an intervening space therebetween. The lower pump housing has a cavity containing a lower impeller. The upper pump housing has a cavity containing an upper impeller. Both impellers are connected to the shaft of the motor. The motor shaft and impellers are driven in one direction during a wash or rinse operation and in the opposite direction during a drain operation.

An annular separation chamber surrounds and forms part of the upper pump housing. The impeller of the upper pump housing pumps water from the vat to a lower spray arm within the vat.

The pump cavity of the lower pump housing has a first passage connected to spray devices located in the middle and/or the upper portions of the dishwasher vat, a second passage connected to a check valve-controlled wash and rinse water inlet tube extending into the separation chamber and a third passage connected to a drain water inlet tube extending into the separation chamber. The separation chamber has an outlet tube connected to drain.

In a first embodiment of the invention, the drain water inlet tube of the separation chamber is provided with a check valve and an outlet opening is formed in the separation chamber top, immediately above the drain water inlet tube. During wash and rinse operations, a majority of the wash or rinse water entering the lower pump housing cavity passes through the first outlet thereof to the spray devices located at the middle and/or upper portions of the dishwasher vat. A lesser amount of the wash or rinse water enters the second outlet of the lower pump housing cavity and enters the separation chamber through the wash and rinse water inlet, shifting the check valve thereof to its open position. The check valve of the drain water inlet tube is in its position to close the drain water inlet tube. The wash or rinse water entering the separation chamber circulates therein and food soil precipitates therefrom. The supernatant wash or rinse water returns to the dishwasher vat through the outlet opening in the separation chamber top. During a drain cycle, the wash and rinse water inlet tube of the separation chamber is closed by its check valve. The water entering the pump cavity of the lower pump housing passes through the third passage thereof and enters the separation chamber through the drain water inlet tube thereof. The check valve of the drain water inlet tube assumes a position opening the drain water inlet tube and closing the outlet opening in the separation chamber top. Water from the drain water inlet tube circulates within the separation chamber and exits the separation chamber via its outlet tube to drain, flushing the precipitated food soils from the separation chamber to drain.

In a second embodiment of the invention, the apparatus is the same except that the drain water inlet tube of the separation chamber is not provided with a check valve and the separation chamber top is not provided with an outlet opening. During a wash or rinse operation a portion of the water entering the pump cavity of the lower pump housing enters the separation chamber in the manner described above. The supernatant wash or rinse water, however, exits the separation chamber through the drain water inlet tube, returning to the pump cavity to be discharged to the vat through the spray devices located at the middle and upper portions of the dishwasher vat. During a drain operation, the water from the pump cavity of the lower pump housing enters the separation chamber through the drain water inlet tube thereof. The wash or rinse water inlet tube is closed by its check valve. The water within the separation chamber exits via the separation chamber outlet tube to drain, carrying the precipitated food soils with it.

BRIEF DESCRIPTION OF THE DRAWING

FIG. 18 is a plan view of the valve guide of the present invention.

FIG. 19 is a bottom view of the valve guide of FIG. 18.

FIG. 20 is a fragmentary cross sectional view taken along section line 20—20 of FIG. 12.

FIG. 24 is a fragmentary cross sectional view, taken along the section line 24—24 of FIG. 12, and illustrating the operation of the apparatus of the present invention during a drain operation of a dishwasher cycle.

DETAILED DESCRIPTION OF THE INVENTION

Figure 1:
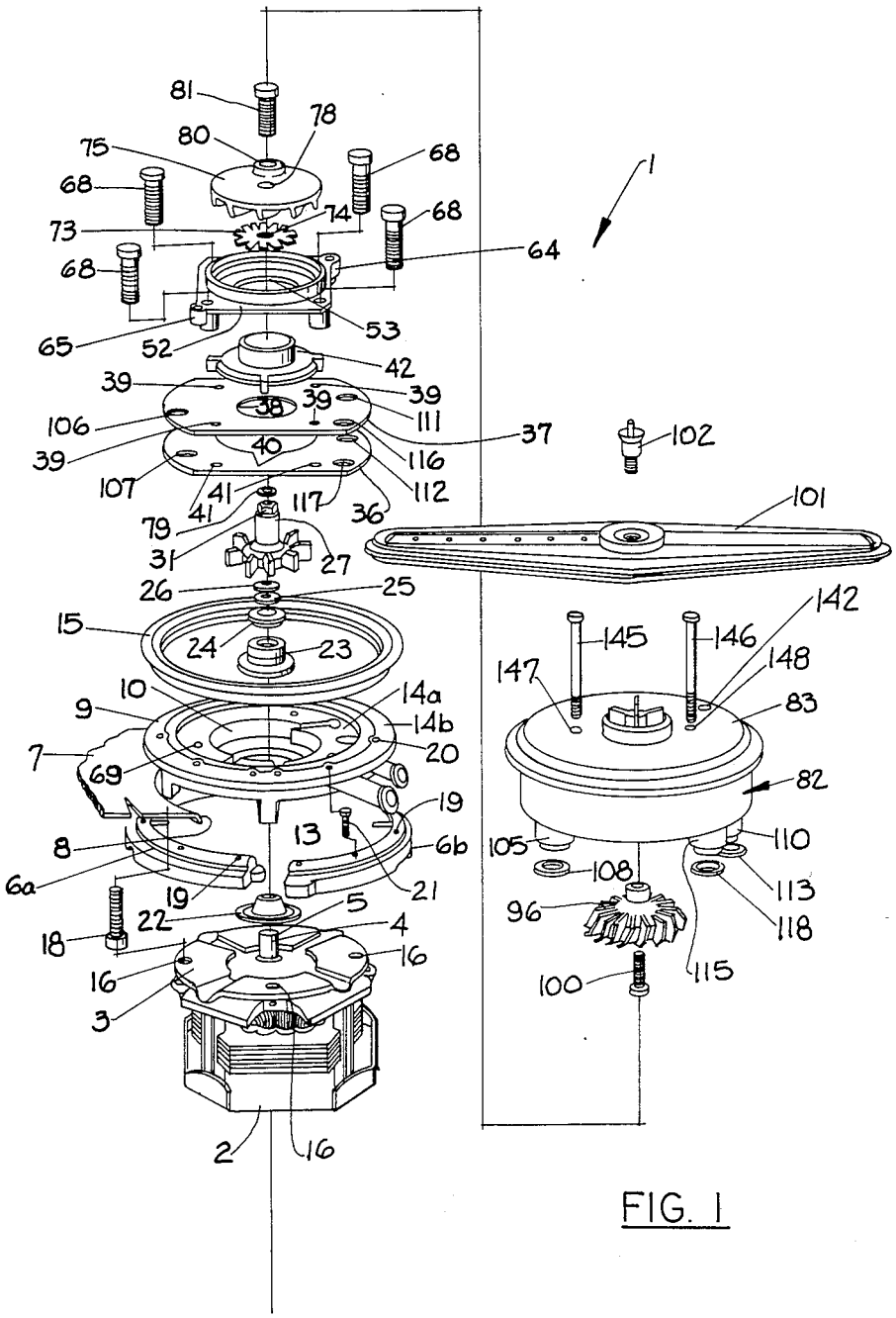
FIG. 1 is an exploded view of the preferred embodiment of the present invention.
Figure 12:
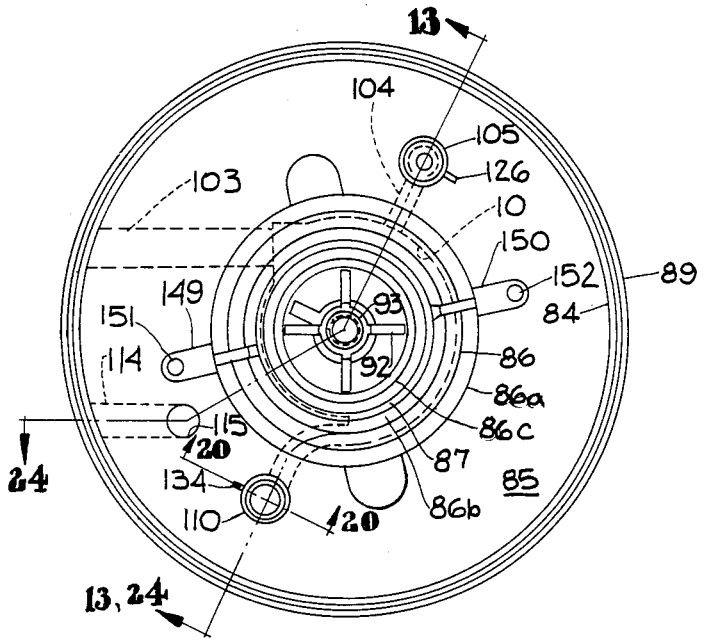
FIG. 12 is a plan view of the structure of FIG. 1 in assembled form, with the spray arm, separation chamber top, inlet baffle, valve guide and check valves removed for clarity.

In all of the figures like parts have been given like index numerals. Reference is generally made to FIGS. 1 and 12, wherein the apparatus of the present invention is illustrated in exploded and assembled conditions, respectively. Each element of the apparatus of the present invention will now be briefly described for a better understanding of the overall structure. The overall structure is generally indicated at 1 and comprises a bi-directional electric motor 2 having a mounting plate 3. The motor 2 has a shaft 4 with an interiorly threaded axial bore 5. The electric motor 2 is surmounted by a pump mounting ring made up of two segments **6*a* and 6*b*. A fragmentary portion of the dishwasher vat bottom is shown at 7. The vat bottom 7 has a circular hole or opening therein, indicated at 8. A lower pump housing is shown at 9 having a pump cavity 10 with a central depressed portion 11 (see FIG. 13) and a perforation 12** therethrough (see also FIG. 2). The pump housing 9 is provided with four integral, downwardly depending legs 13 and a two-step peripheral flange 14a–14b. The pump mounting ring is preferably made of plastic and the lower pump housing 9 lends itself well to be made of a plastic material suitable for use in the environment of a dishwasher and capable of withstanding temperatures encountered in a dishwasher.

Figure 13:
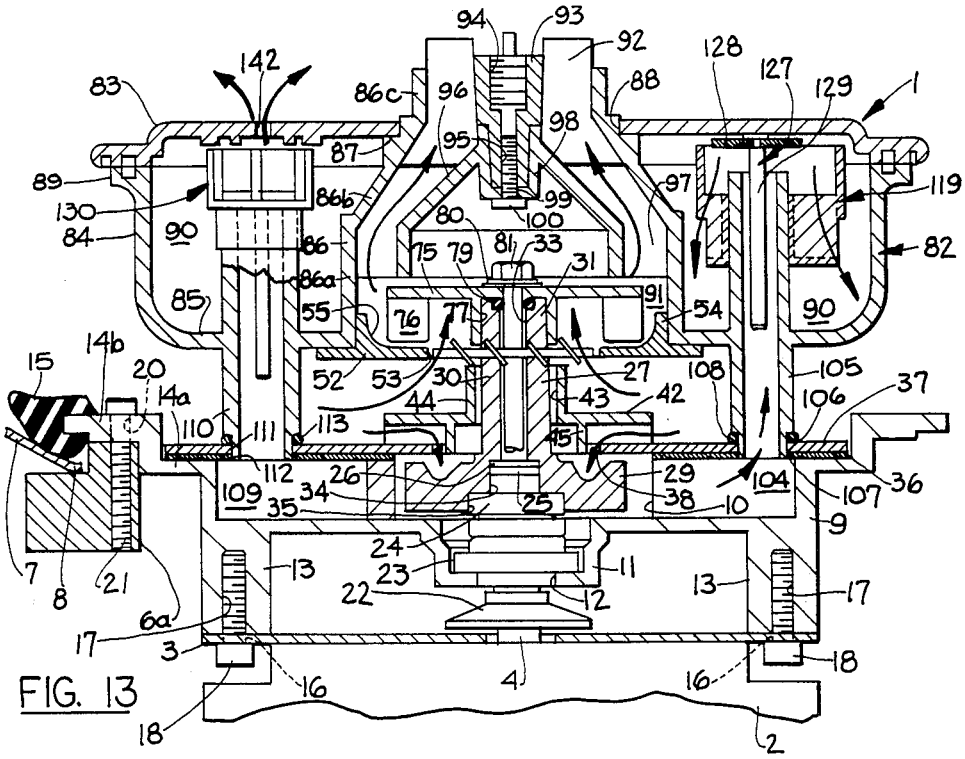
FIG. 13 is a fragmentary cross sectional view taken along section line 13—13 of FIG. 12.

A lower pump housing gasket is shown at 15 and is engageable on the pump housing flange portion 14b, as shown in FIG. 13.

The motor mounting plate 3 is provided with four perforations 16. The four downwardly depending legs 13 of lower pump housing 9 are provided with corresponding, internally threaded perforations 17 (see FIG. 13). The motor 2 and its mounting plate 3 are attached to the legs 13 of pump housing 9 by means of four bolts 18 passing upwardly through the motor mounting plate perforations 16 and threadedly engaged in the pump housing leg perforations 17.

Pump mounting ring segments 6a and 6b are provided with a plurality of threaded perforations 19. The peripheral flange portion 14b of lower pump housing 9 is provided with a corresponding plurality of perforations 20. The lower pump housing 9 is affixed to the pump mounting ring segments 6a and 6b by an appropriate number of bolts 21 passing through the flange perforations 20 of the lower pump housing and threadedly engaged in the perforations 19 of ring segments 6a and 6b. As will be apparent from FIG. 13, the pump mounting ring segments 6a and 6b, in cooperation with the lower pump housing gasket 15, engage that portion of vat bottom 7 adjacent the perforation 8 therein, with a clamping action. It will further be apparent that upon removal of the bolts 21 and pump mounting rings 6a and 6b, the entire apparatus 1 (inclusive of motor 2) can be lifted upwardly and removed from the vat.

The motor shaft 4, adjacent mounting plate 3 and beneath the lower pump housing 9, may have a conventional water shield or slinger 22 non-rotatively affixed thereto and cooperating with mounting plate 3 to protect the motor from water leakage. The motor shaft 4 extends upwardly through the perforation 12 in the depressed portion of the lower pump housing 9 and upwardly into the pump cavity 10. To assure a water tight seal where the motor shaft 4 passes through the perforation 12 of lower pump housing 9, a carbon faced bearing seal 23 may be provided. The carbon faced bearing seal 23 cooperates with a ceramic seal 24. The shaft 4 may be surmounted by several washer-like shims 25 and 26, if required, to assure proper positioning of the lower pump impeller 27 within cavity 10.

Figure 3:
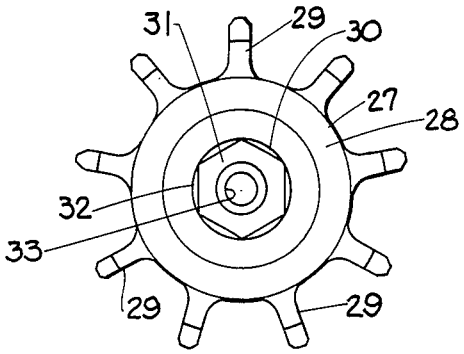
FIG. 3 is a plan view of the lower impeller of FIG. 1.

The motor shaft 4 supports the lower pump impeller 27. The lower pump impeller is also shown in FIG. 3. The lower pump impeller 27 comprises a circular base portion 28 having a plurality of blades 29 extending radially therefrom. The impeller 27 also has an upstanding shaft portion 30 of circular cross section, having an uppermost portion 31 of hexagonal cross section. A narrow annular shoulder 32 is formed between the shaft portions 30 and 31, as shown in FIG. 3. The lower pump impeller 27 has an axial bore 33 with a first portion of enlarged diameter 34 adapted to receive the end of motor shaft 4 (and the shims 25 and 26 if required). The bore 33 has a second portion 35 of even greater diameter, adapted to receive the upper portion of ceramic seal 24 (see FIG. 13). The lower pump impeller 27 lends itself well to being molded of an appropriate plastic material.

Figure 4:
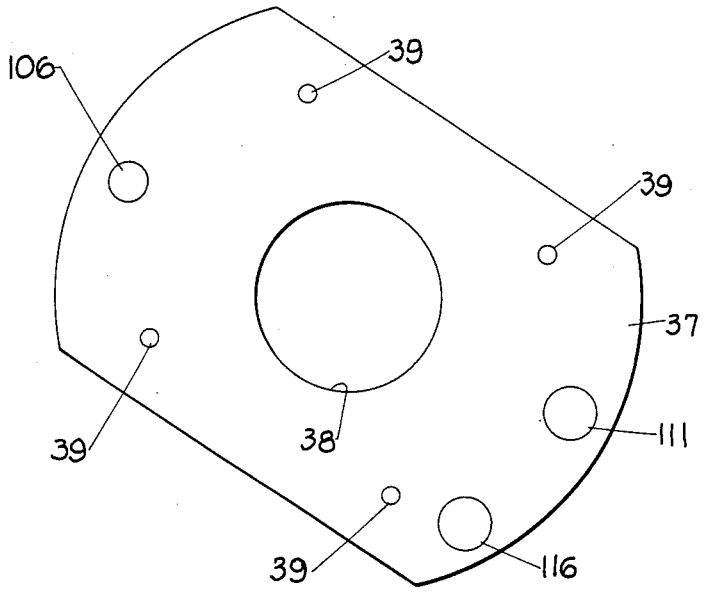
FIG. 4 is a plan view of the lower pump housing plate of FIG. 1.

The upper end of the cavity 10 of lower pump housing 9 is partially closed by a gasket 36 and a lower pump housing plate 37. The lower pump housing plate 37 is preferably made of stainless steel or the like and is most clearly shown in FIG. 4. The lower pump housing plate has a central perforation 38 and four additional perforations 39. The gasket 36 is substantially identical to the lower pump housing plate 37, with the exception that its central opening 40 is larger than the central opening 38 of the lower pump housing plate 37. The gasket has four additional perforations 41, corresponding to the lower pump housing plate perforations 39.

Figure 5:
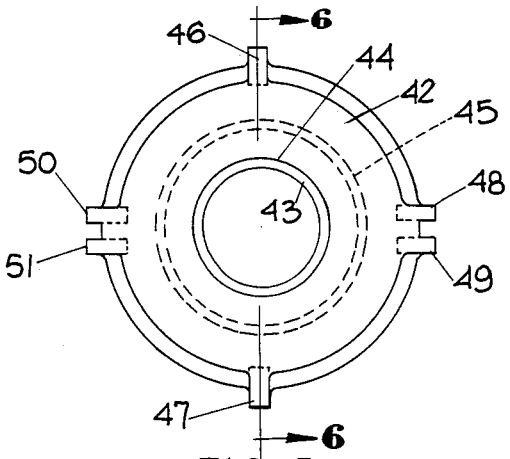
FIG. 5 is a plan view of the shroud of FIG. 1.
Figure 6:
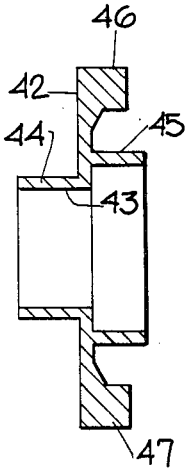
FIG. 6 is a cross sectional view taken along section 6—6 of FIG. 5.

As will be noted from FIG. 13, the gasket 36 and lower pump housing plate 37 rest upon flange portion 14a of the lower pump housing 9. The lower pump housing plate 37 is surmounted by a shroud 42 (see also FIGS. 5 and 6). The shroud 42 lends itself well to be molded of appropriate plastic material and comprises a circular planar member having a central opening 43, surrounded on its upper surface by an upstanding annular wall 44. The underside of the shroud 42 has a downwardly depending annular wall 45, centrally located and of greater diameter than the annular wall 44. At its periphery, shroud 42 has a pair of diametrically opposed, downwardly depending, leg-like lugs 46 and 47. The shroud 42 also has at its periphery and located 90° from lugs 46 and 47, diametrically opposed pairs of downwardly depending, leg-like lugs 48, 49 and 50, 51.

As will be noted from FIG. 13, the shroud 42 is supported by its lugs 46 through 51 on lower pump housing plate 37. The downwardly depending annular wall 45 extends through the lower pump housing plate perforation 38 with clearance to form an annular orifice to meter the proper amount of water to the lower pump. The lower impeller shaft portion 30 extends upwardly through annular shroud wall 44 with clearance.

Figure 7:
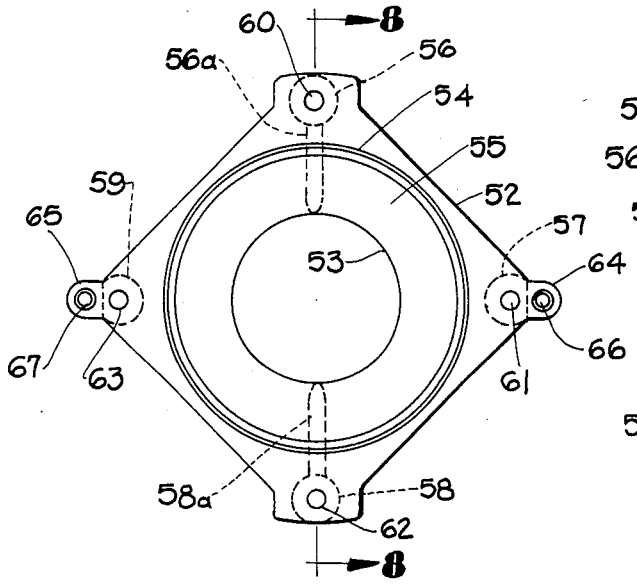
FIG. 7 is a plan view of the spacer plate of FIG. 1.
Figure 8:
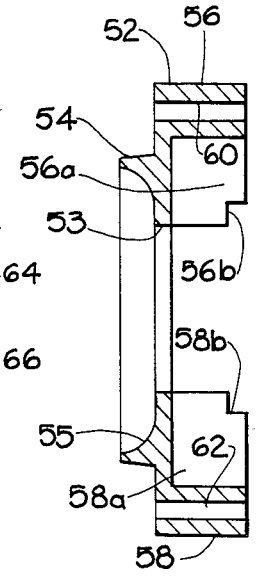
FIG. 8 is a cross sectional view taken along section line 8—8 of FIG. 7.

Above and straddling the shroud 42 there is a spacer plate 52. Reference is also made to FIGS. 7 and 8. The spacer plate comprises a substantially planar, substantially rectangular member having a central, circular opening 53. On its upper side, the spacer plate has an upstanding, annular wall 54 with an arcuate inner surface 55. On its underside, the spacer plate has, at each corner, a downwardly depending leg 56, 57, 58 and 59. Each of the legs 56–59 has an axial bore 60, 61, 62 and 63, respectively. A pair of diagonally opposed lugs 64 and 65 are provided adjacent legs 57 and 59 having internally threaded axial perforations 66 and 67, respectively. To complete the spacer plate, a pair of integral webs 56a and 58a are located on its underside and extending inwardly of legs 56 and 58. The webs 56a and 58a are notched as at 56b and 58b. As in the case of the shroud 42, the lower impeller 27 and the lower pump housing 9, the spacer plate 52 lends itself well to being molded of an appropriate plastic material.

Figure 2:
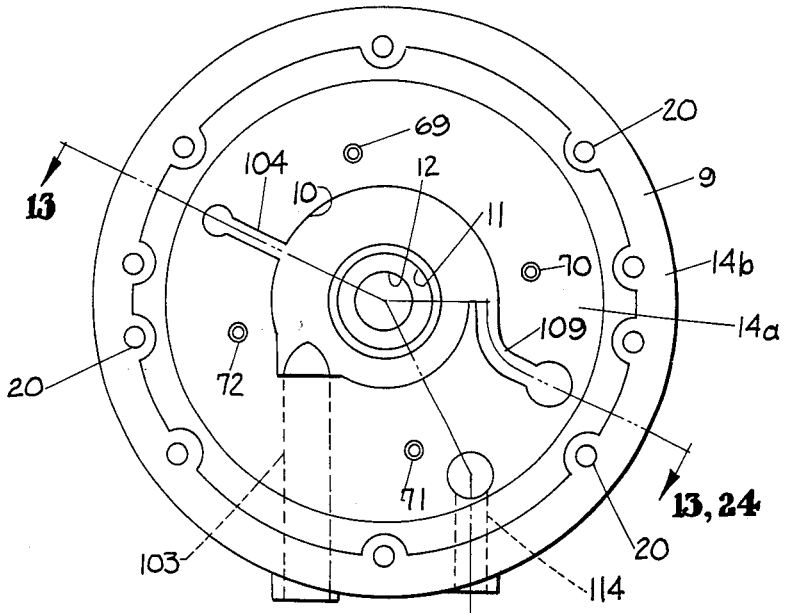
FIG. 2 is a plan view of the lower pump housing of FIG. 1.

As can be best understood from FIG. 1, a series of four bolts 68 pass through the leg perforations 60–63 of spacer plate 52, through the perforations 39 of pump plate 37 and the perforations 41 of gasket 36 and are threadedly engaged in the perforations 69, 70, 71 and 72 of the lower pump housing 9 (see FIG. 2). The notched portion 56b and 58b of spacer plate webs 56a and 58a engage the shroud 42 between its lug pairs 48–49 and 50–51 to hold the shroud in place.

Figure 9:
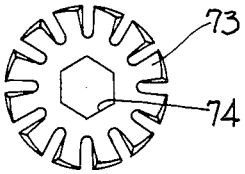
FIG. 9 is a plan view of the macerator blade of FIG. 1.

FIG. 9 illustrates a macerator blade 73. The macerator blade 73 has a central, hexagonal perforation 74. As is most clearly shown in FIG. 13, the macerator blade is mounted on the hexagonal portion 31 of the shaft of lower impeller 27, resting upon its shoulder 32 (see FIG. 3). This locates the macerator blade at the position of the central perforation 53 in spacer plate 52. Macerator blade 73 is perferably made of metal.

Figure 10:
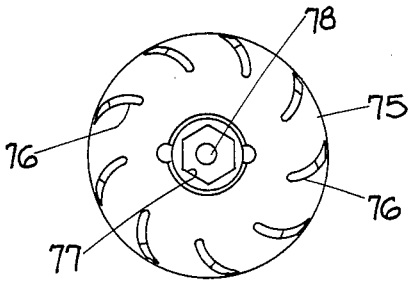
FIG. 10 is a bottom view of the upper impeller of FIG. 1.

To complete the impeller assembly, an upper impeller 75 is provided (see also FIG. 10). The upper impeller 75 comprises a circular member having downwardly depending impeller blades 76 on its underside. Also on its underside, the upper impeller 75 has a hexagonal socket 77. A perforation 78 extends from the upper surface of the upper impeller, through to the hexagonal socket 77.

The uppermost end of lower impeller shaft portion 31 is provided with an O-ring 79 (see FIG. 1 and 3) and is received in the hexagonal socket 77 of the upper impeller 75. The upper impeller 75 is surmounted by a washer 80. An impeller bolt 81 passes through washer 80, the perforation 78 in upper impeller 75, through the O-ring 79 and the central bore 33 of the lower impeller (see FIG. 3) and is threadedly engaged in the axial bore 5 of motor shaft 4. As a result of this, the upper impeller 75, the macerator blade 73 and the lower impeller 27 are securely fastened together and rotate as a unit with the motor shaft 4.

As will be evident hereinafter, the separation chamber, generally indicated at 82, is supported on the structure thus far described by the spacer plate 52. The annular separation chamber 82 is provided with a top 83. The annular separation chamber is most clearly shown in FIG. 12 (with top 83 removed) and in FIG. 13. Separation chamber 82 has an exterior, substantially cylindrical wall 84, a bottom 85 and an inner wall 86. The inner wall 86 has a first cylindrical portion 86*a*, a conical portion 86*b* and a second cylindrical portion 86*c*. A shoulder 87 is formed between inner wall portions 86*b* and 86*c*. The top 83 has a central perforation 88, the peripheral portion of which rests upon the shoulder 87. The outer peripheral portion of the top 83 rests upon an exterior flange 89 located at the upper end of exterior wall 84. The top 83 may be affixed to the annular separation chamber 82 in any appropriate water-tight fashion. Vibration or spin welding is preferred to provide a separation chamber 82 capable of withstanding the relatively low pressures (approximately 7 psi) developed therein. Outer wall 84, bottom 85, inner wall 86 and top 83 define the annular interior 90 of soil separation chamber 82.

The upstanding wall 54 of spacer plate 52 is just nicely received within the lower part of inner wall portion 86*a*. The arcuate interior surface 55 of spacer plate wall 54, together with the lower part of inner wall portion 86*a* form an upper pump chamber or cavity 91, in which the upper impeller 75 is located. Above the upper impeller 75, the inner wall portions 86*b* and 86*c* of the separation chamber 82 support an integral spider 92 having a central hub 93. The central hub 93 has an axial bore, the upper portion 94 of which is internally threaded. The lower portion 95 is of lesser diameter and is also internally threaded.

Figure 11:
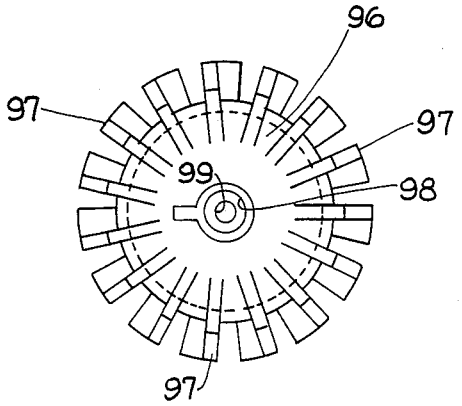
FIG. 11 is a plan view of the diffuser of FIG. 1.

The spider 92 supports a diffuser 96. The diffuser 96 is shown in a plan view in FIG. 11. The diffuser has a plurality of radially extending diffuser blades 97, the lower portions of which are of arcuate configuration. At its upper end, the diffuser has a socket 98 and a central bore 99. As is most clearly shown in FIG. 13, the socket 98 is adapted to receive the lower portion of spider hub 93. A diffuser bolt 100 passes through the perforation 99 of the diffuser and is threadedly engaged in the spider hub bore 95. Turning to FIG. 1, a lower spray arm 101 is rotatively mounted about wall 86*c* by means of a shouldered bolt 102, threadedly engaged in the spider bore 94.

Returning to FIG. 2, the pump chamber 10 of lower pump housing 9 has a main outlet or passage 103 connected to spray arm(s) (not shown) in the middle and/or upper parts of the dishwasher vat. The lower pump housing 9 has a second outlet 104 or passage formed therein. As is most clearly shown in FIG. 13, the second passage 104 is connected to a vertical wash and rinse water inlet tube 105, constituting an integral part of separation chamber 82. The tube 105 extends upwardly within the annular interior 90 of separation chamber 82. The lower end of tube 105 is of reduced diameter and extends through perforations 106 in lower pump housing plate 37 and 107 in gasket 36. An O-ring 108 is provided to assure a water tight seal.

Returning to FIG. 2, the lower pump housing 9 has a third outlet or passage 109 formed therein for the pump chamber 10. As is most clearly shown in FIG. 13, the separation chamber 82 has an integral, vertical drain water inlet tube 110 formed therein. The tube 110 extends upwardly into the annular interior 90 of the separation chamber 82. The lower end of the tube 110 is of smaller diameter and passes through perforations 111 and 112 in the lower pump housing plate 37 and the gasket 36 to connect with passage 109. Again, an O-ring 113 is provided to assure a water tight connection.

As shown in FIG. 2. The lower pump housing 9 has formed in it an outlet or passage 114. The passage is connected to drain. Reference is now made to FIGS. 12 and 24. As can be seen in these figures, the separation chamber 82 is provided with a vertical outlet tube 115 which extends downwardly from the bottom 85 of the separation chamber. The lowermost end of outlet tube 115 is reduced in diameter and passes through the perforation 116 in the lower pump housing plate 37 and the perforation 117 in gasket 36. Again, an O-ring 118 is provided to assure a water tight seal. In this fashion, the separation chamber outlet tube 115 is connected directly to lower pump housing drain passage 114.

Attention is drawn to FIGS. 13 through 17. The wash and rinse water inlet tube 105 of separation chamber 82 is provided with an inlet baffle, generally indicated at 119. The inlet baffle 119 comprises a cylindrical or tubular member 120, of such diameter as to be just nicely received over the upper end of separation chamber tube 105. The tubular member 120 has a horizontal, circular, planar member 121 at its bottom end. As will be most apparent from FIG. 14, the tubular member 120 is somewhat off-set with respect to the planar member 121.

A pair of diametrically opposed webs 122 and 123 extend laterally from the tubular member 120 and support an annular or cylindrical member 124 having a diameter slightly larger than the diameter of the planar member 121. The annular member 124 is spaced upwardly from the planar member 121, as can be clearly seen from FIGS. 16 and 17.

Figure 14:
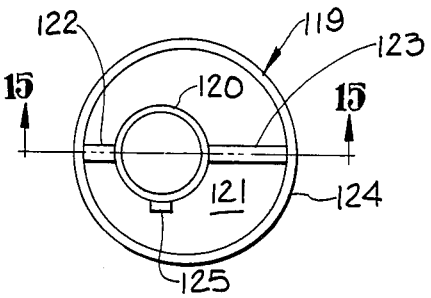
FIG. 14 is a plan view of the inlet baffle of the present invention.
Figure 15:
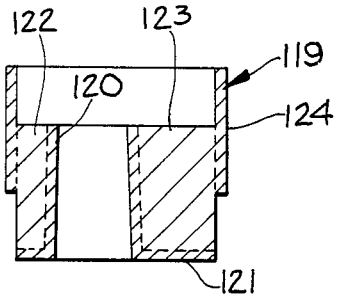
FIG. 15 is a cross sectional view taken along section line 15—15 of FIG. 14.
Figure 16:
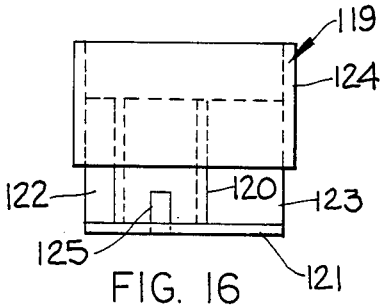
FIG. 16 is an elevational view of the inlet baffle of FIG. 14.
Figure 17:
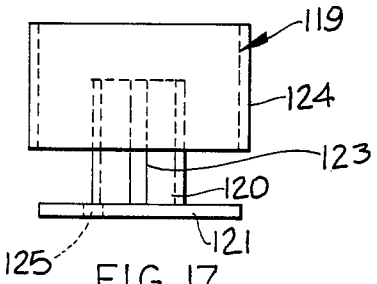
FIG. 17 is an elevational view of the inlet baffle, as seen from the right of FIG. 16.

A slot 125 is formed in both the tubular member 120 and the planar member 121, as is most clearly determined from FIGS. 14 and 16. In FIG. 12, it is to be noted that the separation chamber tube 105 has a laterally extending key 126. The upper end of key 126 is received in slot 125 of inlet baffle 119 and determines both the vertical and the angular positions of the inlet baffle 119 with respect to the separation chamber tube 105. As will be noted in FIG. 13, the upper end of inlet baffle 119 is only slightly spaced from the inside surface of separation chamber top 83. This separation space should be made as small as is practical.

As is shown in FIG. 13, the separation chamber tube 105 is provided with a check valve, generally indicated at 127. Check valve 127 comprises a rubber disk 128 and a downwardly depending metallic pin 129, preferably made of stainless steel or the like. The pin 129 extends downwardly into the tube 105 and serves as a guide for check valve 127. It also adds mass to the check valve 127, which is operated by pressure and gravity, as will be explained hereinafter. The upward movement of the check valve 127 is limited by its abutment with the inside surface of the top 83 of separation chamber 82.

Reference is now made to FIGS. 12, 13, 18, 19, and 20. The drain water inlet tube 110 of separation chamber 82 is provided with a valve guide, generally indicated at 130. Valve guide 130 comprises a circular disk-like horizontal member 131 having a central opening 131*a* formed therein. On its underside, the opening 131*a* is surrounded by a downwardly depending annular sleeve 132 having a notch 133 formed therein. The sleeve 132 is of such diameter as to just nicely receive the upper end of tube 110. As is most clearly shown in FIG. 12, the tube 110 has a latterally extending key 134 formed thereon. The key 134 is adapted to be received in the slot 133 to determine the vertical and angular positions of valve guide 130 with respect to tube 110. On the upper surface of the disk-like member 131 of valve guide 130 there is provided an upstanding, arcuate wall 135 extending about half way around the periphery of disk-like member 131. At the remainder of the periphery of member 131 there are upstanding pegs 136, 137 and 138 having a vertical height substantially equal to arcuate wall 135.

It will be noted from FIG. 20, which is a fragmentary, cross sectional, elevational view of separation chamber 82, its top 83 and its tube 110, that the tube 110 is provided with a check valve, generally indicated at 139 and similar to the check valve 127 of separation chamber tube 105. To this end, check valve 139 comprises a rubber disk 140 having a metallic pin 141 which extends downwardly in separation chamber tube 110 to act as a guide for check valve 139 and to lend mass thereto, since the check valve is operated by pressure and gravity, as will be described hereinafter.

It will be further noted from FIG. 20 that the top 83 of separation chamber 82 has an outlet opening 142 formed therein. It will be evident from FIG. 20 that when the check valve 139 is in its lowermost position, as shown, it will close the upper end of tube 110. When in its uppermost position, the check valve 139 will abut the annular seat 143 formed on the inside surface of separation chamber top 83 and about the outlet opening 142, closing outlet opening 142. An additional annular flange 144, is concentric with and of larger diameter than the annular seat 143. Annular flange 144 depends downwardly from the inside surface of separation chamber top 83 to minimize the separation distance between it and the arcuate wall 135 and pegs 136, 137 and 138 of valve guide 130.

To complete the structure of the present invention, the separation chamber 82 is affixed to spacer plate 52 by a pair of bolts 145 and 146. To this end, separation chamber top 83 is provided with perforations 147 and 148 (see FIG. 1). The interior surface of inner wall portion 86*a* of the separation chamber is provided with laterally extending lugs 149 and 150 having vertical perforations 151 and 152 (see FIG. 12) extending therethrough, respectively. Bolt 145 extends through separation chamber top perforation 147 and separation chamber lug perforation 151, being threadedly engaged in the lug 65 of spacer plate 52. In similar fashion, the bolt 146 passes through separation chamber top perforation 148, separation chamber lug perforation 152 and is threadedly engaged in the spacer plate lug 64.

The apparatus of the present invention having been described in detail, its operation will now be set forth. Because the pump assembly is located in the lowest part of the dishwasher vat, both the lower impeller 27 and the upper impeller 75 are submerged when the proper amount of water is admitted to the vat. As a result of this, when motor 2 is energized and its shaft 4 rotated in the wash or rinse direction (i.e. counterclockwise as viewed in the drawings), water is drawn into the space between the lower pump housing plate 37 and the spacer plate 52 to flow upwardly through the macerator blade 73 to the upper impeller 75 in upper pump chamber 91. The upper impeller forces water past diffuser 96, the blades 97 of which remove a good bit of the swirl of the water. This water enters the lower spray arm, causing it to rotate, which in turn causes the wash or rinse water from the spray arm to impinge upon the tableware in the lower rack of the dishwasher.

Figure 21:
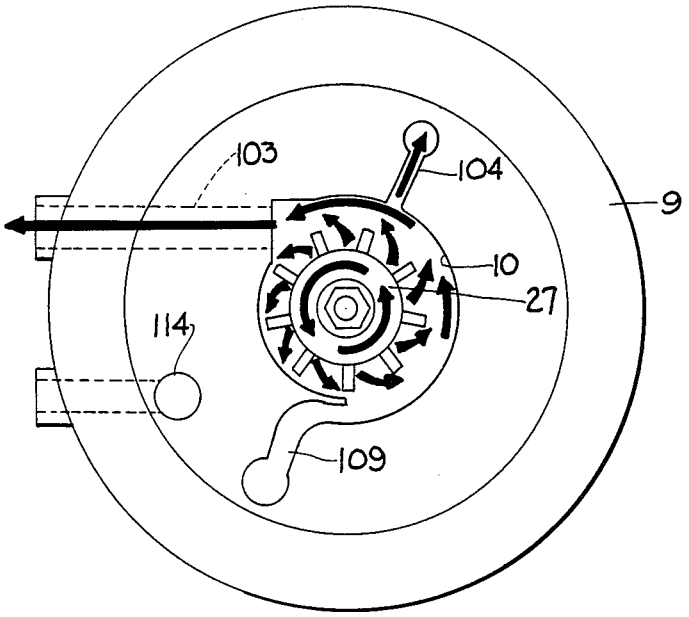
FIG. 21 is a simplified plan view of the lower pump housing, diagrammatically illustrating the action of the lower pump during a wash or rinse operation of a dishwasher cycle.

Water located between the lower pump housing plate 37 and the spacer plate 52 is also drawn by lower impeller 27 beneath the horizontal portion of shroud 42 and through the central opening 38 of lower pump housing plate 37 into the lower pump housing cavity 10. As is diagrammatically illustrated in FIG. 21, the lower impeller 27, when rotating in a washing or rinsing direction, causes most of the water to be discharged through outlet 103 to spray arms (not shown) in the middle and/or the upper part of the dishwasher. A smaller portion of the water in cavity 10 is diverted through outlet 104 and is caused to enter separation chamber 82 via the separation chamber wash and rinse water tube 105. In an exemplary embodiment, the lower pump comprising cavity 10 and impeller 27 had a capacity of about 14 gallons per minute when operating in the direction of washing or rinsing. About one and one half gallons per minute were diverted through outlet 104 into separation chamber 82. The flow rate through separation chamber 82 is determined by a number of factors such as diameter of outlet opening 142, inner diameter of tube 105, pressure in lower pump cavity 10, diameter of pump housing passage 104 and the like. It is to be further noted from FIG. 21, that by virtue of its shape, outlet 109 receives substantially no water when the impeller is running in the washing or rinsing direction.

Figure 22:
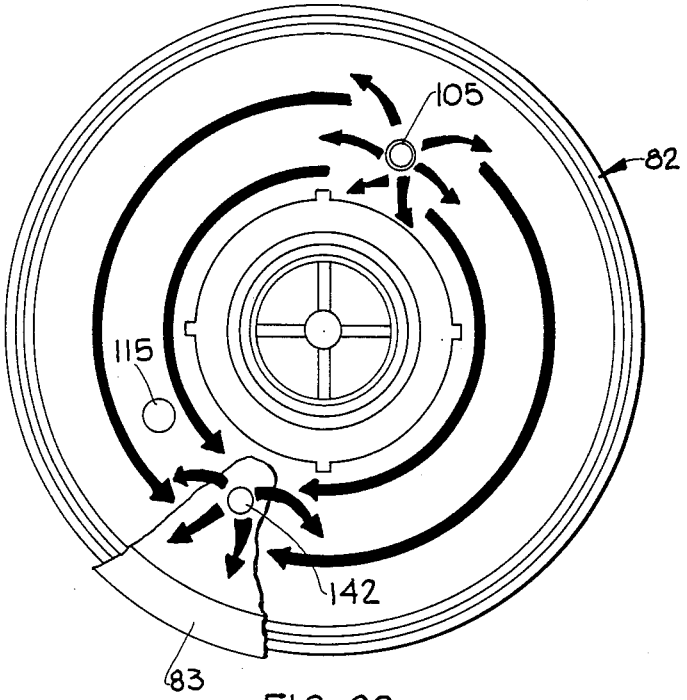
FIG. 22 is a simplified plan view of the separation chamber, with a fragment of its top shown in place, and diagrammatically illustrating its operation during a wash or rinse operation of a dishwasher cycle.

Reference is now made to FIGS. 13 and 22. Water entering tube 105 of separation chamber 82 creates pressure on the lower side of check valve 127, causing it to open (as shown in FIG. 13). The inlet baffle 119, located substantially adjacent the inside surface of the separation chamber top 83, diverts the wash or rinse water, containing soil particles, downwardly into the large volume of the separation chamber 82. As is diagrammatically illustrated in FIG. 22, the water flows about inner wall 86 in both directions, by virtue of webs 122 and 123 of inlet baffle 119, toward the outlet opening 142 in the separation chamber top 83. Pressure beneath check valve 139 in separation chamber tube 110 is substantially reduced by the aspirator effect produced by the counterclockwise rotation of lower impeller 27, causing check valve 139 to remain in its lower position as shown in FIG. 13, closing the upper end of separation chamber tube 110 and opening the outlet opening 142 in the separation chamber top 83.

A certain amount of time is required to allow soil particles to precipitate from the water. This time is controlled by the velocity of the water through the filter chamber from the tube 105 to the outlet opening 142. The lower the velocity of the water, the shorter the distance required to provide the necessary time. In many prior art filters, the water is caused to flow almost completely around the filter from inlet to outlet by means of baffles and partitions. In the filter of the present invention, by arranging the tube 105 diametrically opposite the outlet opening 142, the water is allowed to flow through two equal paths thus reducing the velocity of each stream to one half that which it would be if it were directed in the same manner as in the prior art structures. This allows the paths to be much shorter and the filter to be considerably less bulky.

Since the water enters separation chamber 82 from tube 105 near the top, and since water exits from the separation chamber through the outlet opening 142 in separation chamber top 83, the entrance and exit of the water causes minimal disturbance to the lower portion of the water in separation chamber 82. This, in turn, allows the soil that has settled to the bottom of the chamber to remain undisturbed, and allows the supernatant liquid from which the soil has settled to be removed from the chamber through the outlet opening 142. Water will not flow into drain tube 115 because of the opposing column of water standing in the drain hose (not shown) connected to the drain port or passage 114 of lower pump housing 9.

As this process is continued during washing or rinsing operations of the dishwasher cycle, more and more of the particulate matter is collected from the water and held in the separation chamber 82.

It must be noted that those food soils which are soluable in water, or are dispersed in water as a colloidal suspension, cannot be removed by filtering or precipitation. Such food soils can only be removed by draining the water and replacing it with fresh water a sufficient number of times to be certain that this repeated dilution has reduced these soils to the point where they are no longer significant.

In this preferred embodiment of the present invention, it will be noted that the supernatant from which the food soils have precipitated is returned directly to the dishwasher machine vat through the outlet opening 142 of separation chamber 82.

Figure 23:
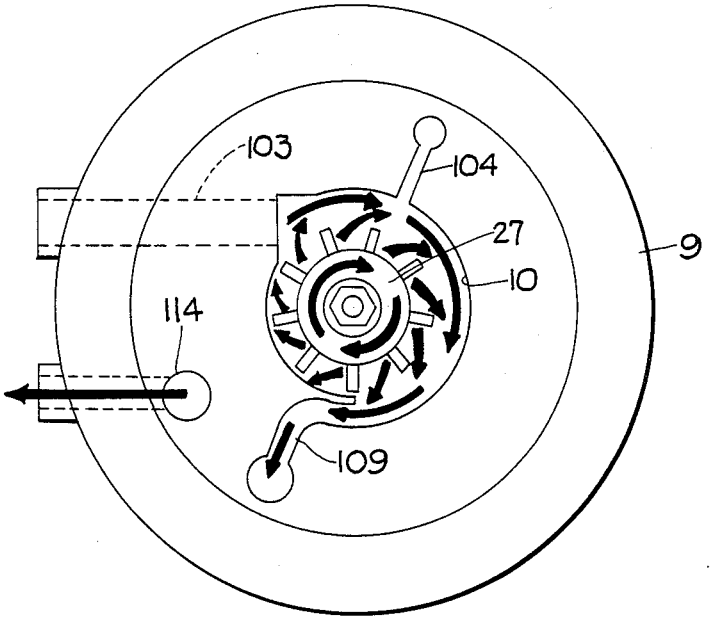
FIG. 23 is a simplified plan view of the lower pump housing, diagrammatically illustrating the action of the lower pump during a drain operation of a dishwasher cycle.
Figure 25:
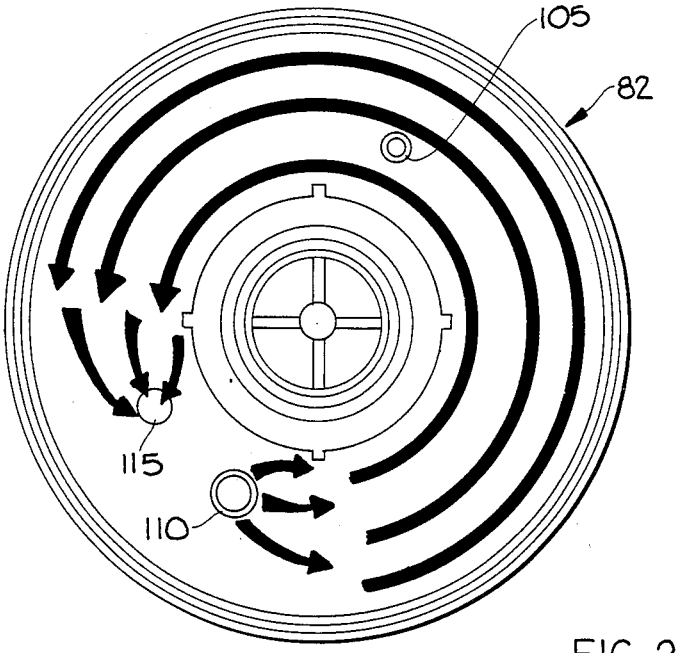
FIG. 25 is a simplified plan view of the separation chamber, with its lid removed, and illustrating its operation during a drain operation of a dishwasher cycle.

When a washing or rinsing operation has ended, the motor 2 stops and reverses its direction of rotation to pump water out of the vat. As the lower impeller 27 turns in a clockwise direction (see FIG. 23) water enters the lower pump chamber 10 through the center opening 38 of lower pump housing plate 37 and is discharged through lower pump housing outlet 109, to enter the separation chamber 82 via the drain water inlet tube 110 thereof. This is illustrated in FIGS. 24 and 25. In the drain mode of operation, there is sufficient pressure in the tube 110 to raise check valve 139, opening the upper end of tube 110 and closing the outlet opening 142 of the separation chamber top 83. At the same time, there is insufficient pressure developed in wash and rinse water inlet tube 105 to lift check valve 129, and, as a result, check valve 129 closes the upper end of separation chamber tube 105. Thus, all of the water is discharged into 82 through its tube 110. The arcuate wall 135 on the valve guide mounted on tube 110 acts as a flow guide, directing the water in a counter-clockwise direction completely around the separation chamber 82 to its outlet tube 115, as is shown in FIG. 25. The opening of outlet tube 115 is flush with the bottom 85 of the separation chamber 82 so that soil that has collected on the bottom 85 of separation chamber 82 is swept into the outlet tube 115. The full pressure developed by the pump is available to force the water and food soil out through outlet tube 115, lower pump housing outlet 114 and the drain hose (not shown) connected thereto. In the above noted exemplary embodiment, the flow rate through the separation chamber 82 in the drain mode was approximately four gallons per minute. In this way, during a drain operation, the separation chamber 82 is flushed clean of food soils and no special attention is required from the dishwasher operator.

Figure 26:
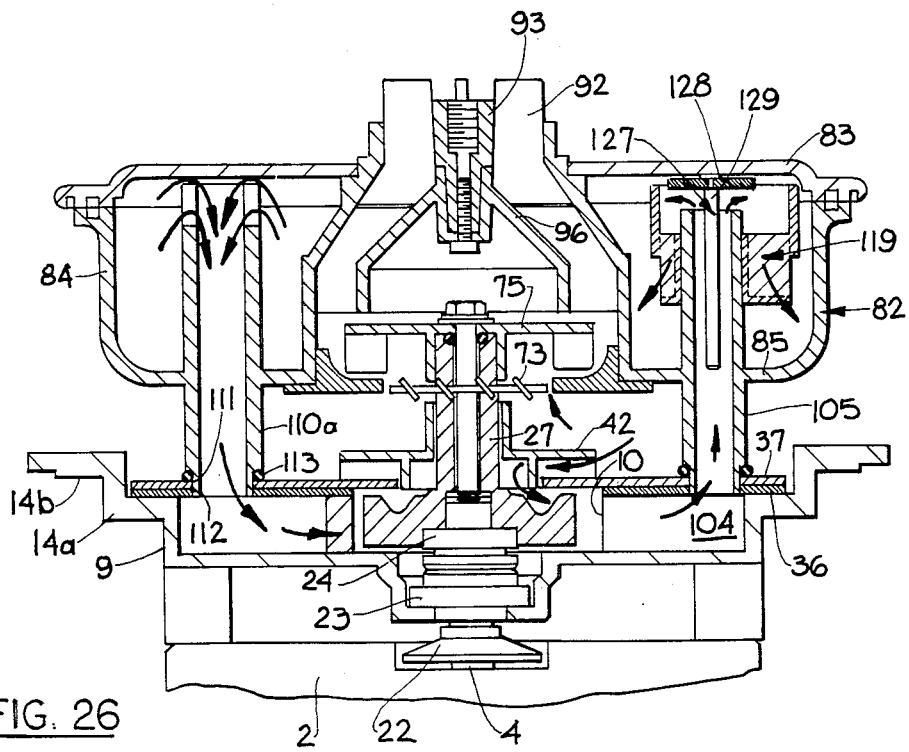
FIG. 26 is a fragmentary cross sectional view, similar to FIG. 13, but illustrating a second embodiment of the present invention.
Figure 27:
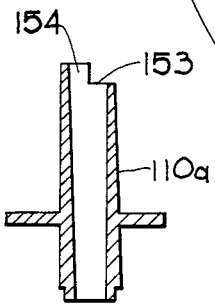
FIG. 27 is a fragmentary cross sectional view of the drain inlet tube of the separation chamber of FIG. 26.

Reference is now made to FIGS. 26 and 27, wherein a second embodiment of the present invention is illustrated. The embodiment of FIGS. 26 and 27 differs from the preferred embodiment just described in only two respects, the configuration of the drain water inlet tube (designated 110*a* in FIGS. 26 and 27) of the separation chamber, and the fact that the separation chamber top 83 is not provided with an outlet opening equivalent to outlet opening 142 of FIG. 13.

The tube 110*a* extends upwardly in the separation chamber nearly to the top 83 thereof. The tube 110*a* extends downwardly, and its lowermost end is of reduced diameter so as to be received in the perforation 111 of lower pump housing plate 37 and the perforation 112 of gasket 36. O-ring 113 is again provided to assure a water tight seal.

The upper end of tube 110*a* is not provided with a check valve equivalent to check valve 139 of FIG. 13 and is not provided with a valve guide equivalent to valve guide 130 of FIG. 13. Instead, the upper end of tube 110*a* is notched (as at 153 in FIG. 27) so as to leave an upstanding arcuate wall portion 154, similar to the arcuate wall 135 of valve guide 130 and serving substantially the same purpose. The uppermost edge of wall portion 154 approaches the inner surface of separation chamber top 83 as closely as is practicable.

Figure 28:
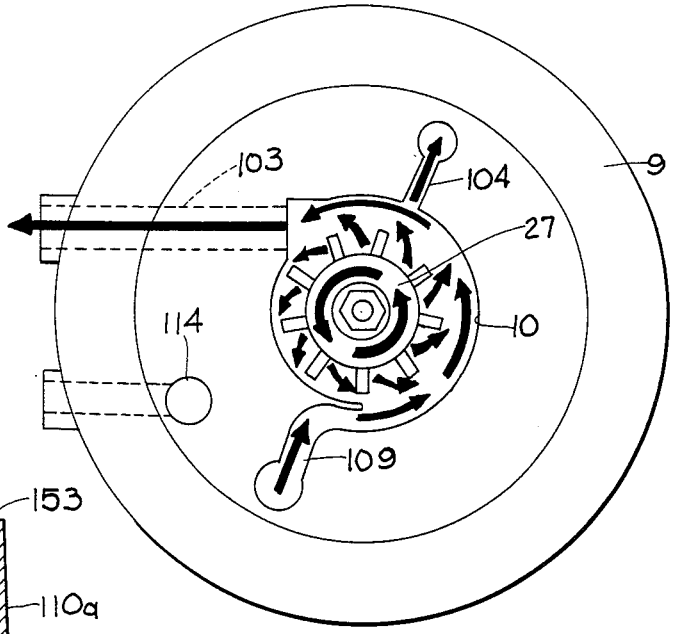
FIG. 28 is a simplified plan view of the lower pump housing, similar to FIG. 21, but illustrating the action of the lower pump during a wash or rinse operation of a dishwasher cycle in the second embodiment of the present invention.
Figure 29:
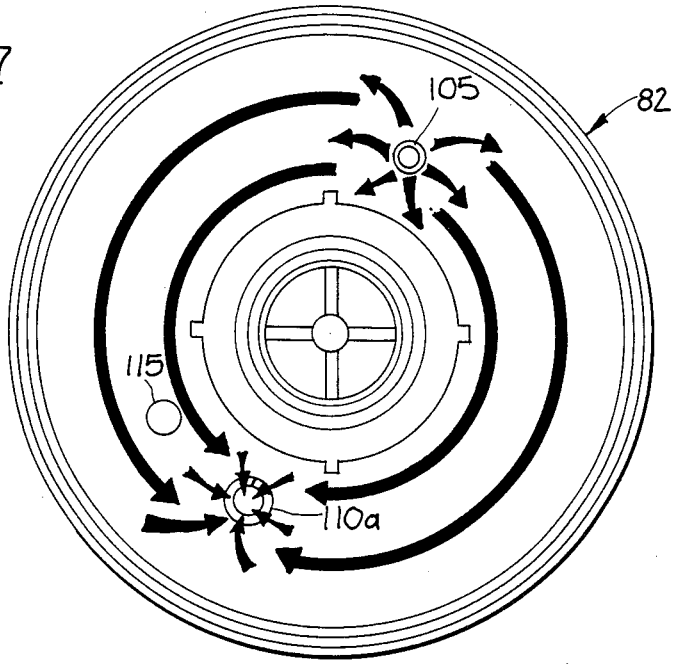
FIG. 29 is a simplified plan view of the separation chamber with its top removed, similar to FIG. 22 and illustrating the action of the separation chamber in the second embodiment of the present invention, during a wash or rinse operation thereof.

When the motor 2 is rotated in the wash or rinse direction, the action of the lower pump assembly is diagrammatically shown in FIG. 28. It will be noted that FIG. 28 is similar to FIG. 21 and the majority of the water pumped by lower impeller 27 passes through outlet 103 to the spray arms (not shown) in the middle and/or the upper part of the dishwasher vat. As in the case of the preferred embodiment, a portion of the water pumped by lower impeller 27 passes through lower pump housing outlet 104 and enters separaticn chamber 82 via tube 105 and inlet baffle 119. The operation of the embodiment of FIG. 26 differs from that of FIG. 13 in that the supernatant fluid does not exit separation chamber 82 directly into the dishwasher vat through an outlet opening 142 in the separation chamber top 83. Rather, the supernatant material is drawn through the separation chamber tube 110*a* and the passage 109 in the lower pump housing to the pump chamber 10 by the aspirating effect of the counterclockwise rotating lower impeller 27. Thus, the supernatant fluid joins the wash or rinse water being pumped through lower pump housing outlet 103 to spray arms (not shown) in the middle and/or the upper part of the dishwasher, and thus re-enters the vat in that fashion. Again, since the water entering and exiting the separation chamber does so near the inside surface of the separation chamber top 83, the precipitated food soils are not disturbed by the flow through the separation chamber 82. The flow through the separation chamber 82 is illustrated in FIG. 29. Again, water will not flow into the outlet tube 115 of the separation chamber because of the opposing column of water standing in the drain hose (not shown), connected to the outlet 114 of lower pump housing 9.

Figure 30:
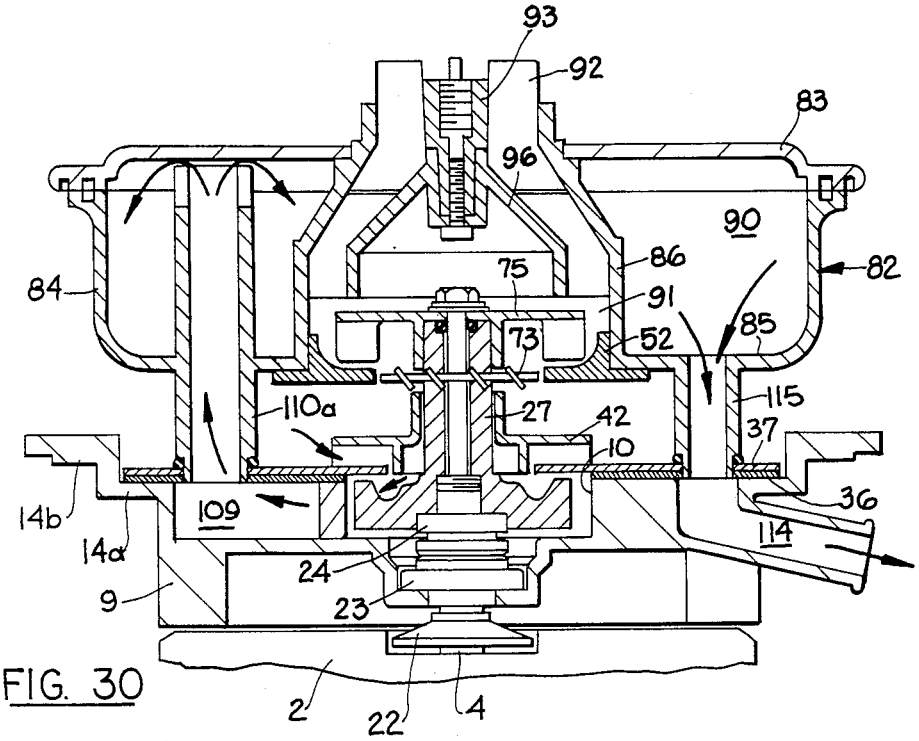
FIG. 30 is a fragmentary cross sectional view, similar to FIG. 24, but illustrating the second embodiment of the present invention during a drain operation of the dishwasher cycle.

The functioning of the apparatus of this second embodiment, during a drain operation of the dishwasher cycle, is substantially identical to that described with respect to the first embodiment. At the end of the washing period, the motor 2 stops and reverses to pump the wash or rinse water out of the vat. The action of the lower impeller is the same as that described with respect to FIG. 23. As is shown in that figure and FIG. 30, water entering the lower pump housing cavity 10 through the opening 38 of the lower pump housing plate 37 is caused to enter outlet 109 of the lower pump housing, and the separation chamber 82 via tube 110*a*. The arcuate wall portion 154 of tube 110*a* causes the water to flow within the separation chamber in the manner illustrated in FIG. 25. Insufficient pressure is developed at lower pump housing outlet 104 to lift the check valve 127 (see FIG. 26) and the check valve 127 achieves its lower position, closing separation chamber tube 105.

The water entering separation chamber 82 from its tube 110*a* passes in a counterclockwise direction completely around the chamber to outlet tube 115 and the food soil, collected at the bottom of the separation chamber, is swept into outlet tube 115 and outlet 114 of the lower pump housing, to drain. Again, in an exemplary embodiment the flow rate was approximately four gallons per minute, and the full pressure developed by lower impeller 27 is available to force the water and soil out through the drain hose.

Modifications may be made in the invention without departing from the spirit of it. For example, the various bolts which hold the assembly of the present invention together could be self-tapping bolts, eliminating the requirement of pre-tapping the various bolt holes in the structure.

What is claimed is:

1. Filter apparatus for removing soil from the wash and rinse waters of ar automatic dishwasher of the type capable of cycles having wash, rinse, and drain operations, and of the type having a vat, a drain for said vat and spray means within said vat, said filter apparatus comprising a water pump and an annular container having a bottom, an inner wall, an outer wall and a top defining an annular separation chamber, said pump having a water inlet adjacent the bottom of said vat and a first outlet connected to said spray means, said pump having a second outlet, said separation chamber having a wash and rinse waters inlet connected to said second pump outlet, said separation chamber wash and rinse waters inlet having a check valve permitting water to flow only from said wash and rinse waters inlet into said separation chamber, said pump having a third pump outlet, said chamber having a drain water inlet connected to said third pump outlet, said chamber having a wash and rinse waters outlet means to return said wash and rinse waters to said vat, said chamber having a drain water outlet connected to said drain, a bidirectional motor connected to said pump, said motor being energizable in a first direction during said wash and rinse operations to cause said pump to pump a portion of said wash and rinse waters from said vat through said first pump outlet to said spray means and a portion of said wash and rinse waters through said second pump outlet and said separation chamber wash and rinse water inlet into and through said separation chamber to said wash and rinse water outlet means thereof, said motor being energizable in a second direction during a drain operation to cause said pump to pump water from said vat through said third pump outlet and said separation chamber drain water inlet into and through said separation chamber to said drain water outlet thereof, whereby soil from said wash and rinse waters is trapped within said separation chamber by sedimentation during said wash and rinse operations, and said soil is flushed from said separation chamber to drain during said drain operation.

2. The filter apparatus claimed in claim 1 wherein said water pump comprises a lower pump housing mounted in a perforation in the bottom of said vat in sealing engagement with the periphery of said perforation, said motor being mounted to and beneath said lower pump housing, said lower pump housing having a pump cavity and a central vertical opening, said motor having a vertical shaft extending through said lower pump housing opening and into said pump cavity, means providing a water-tight seal between said motor shaft and said lower pump housing opening, a lower impeller mounted on said motor shaft and within said lower pump housing cavity, said lower pump housing having said water inlet and said first, second and third outlets all communicating with said cavity, a spacer plate having downwardly depending legs being mounted on and in parallel spaced relationship above said lower pump housing, said separation chamber being supported by said spacer plate, said spacer plate and said inner wall of said separation chamber defining an upper pump housing, said spacer plate having a central opening therein constituting an upper pump housing inlet communicating with said vat, said lower impeller having a shaft-like extension passing through said upper pump housing inlet, an upper impeller located within said upper pump housing and mounted on said lower impeller extension, a shroud about said lower impeller extension from said lower pump housing inlet to said upper pump housing inlet, a spray arm rotatively supported by and above said separation chamber, said upper pump housing having an upper pump housing outlet communicating with said spray arm, diffuser means in said upper pump housing above said upper impeller to impart linear flow to water exiting upper pump housing via said outlet thereof.

3. The filter apparatus claimed in claim 2 including a macerator blade mounted on said lower impeller extension at said upper pump housing inlet.

4. The filter apparatus claimed in claim 2 wherein said wash and rinse waters inlet of said separation chamber comprises a vertical tube-like structure passing through said bottom of said separation chamber and having a lower end connected to said second pump outlet in water tight fashion and an upper end approaching said top of said separation chamber, said check valve of said wash and rinse waters inlet comprising a disc-like member normally resting on said upper end and closing said upper end of said wash and rinse waters inlet tube with a downwardly depending stem located within said wash and rinse waters inlet tube, said check valve being shiftable upwardly to an open position by wash and rinse waters passing through said wash and rinse waters inlet tube to said separation chamber, said drain water inlet of said separation chamber comprising a tube-like structure passing through said bottom of said separation chamber and having a lower end connected to said third pump outlet in water-tight fashion and an upper end approaching said top of said separation chamber, said drain water inlet tube being located substantially diametrically opposite said wash and rinse waters inlet tube in said separation chamber, said drain water outlet of said separation chamber being located near and to one side of said drain water inlet tube, said drain water outlet comprising a tube-like member depending from said bottom of said separation chamber and having a lower end connectable to drain and an upper end flush with the inside surface of said bottom of said separation chamber.

5. The filter apparatus claimed in claim 4 wherein said drain water inlet tube serves as said wash and rinse waters outlet means during said wash and rinse operations, whereby during said wash and rinse operations wash and rinse waters enter said separation chamber via said wash and rinse waters inlet tube and the supernatant wash and rinse waters after sedimentation exit said chamber to said vat via said drain water inlet tube, said pump and said spray means, and during a drain operation drain water enters said separation chamber via said drain water inlet tube and exits the separation chamber together with the collected soil via said separation chamber drain water outlet, said wash and rinse water inlet tube being closed by its check valve.

6. The filter apparatus claimed in claim 5 including a baffle mounted on said upper end of said wash and rinse water inlet tube, said baffle comprising a tubular member having an inner diameter such as to just nicely receive the upper end of said wash and rinse waters inlet tube and to be mounted thereon, a circular planar horizontal member having a perforation therein slightly off-center with respect thereto is affixed to the bottom end of said baffle tubular member, said circular horizontal planar member perforation having a diameter equal to said inner diameter of said baffle tubular member and being coaxial therewith, said baffle tubular member having a pair of diametrically opposed vertical lateral flanges extending along and coplanar with a diameter of said circular horizontal planar member and with a diameter of said circular horizontal planar member perforation, said flanges supporting a cylindrical member coaxial with said circular horizontal planar member, said cylindrical member having a lower edge spaced upwardly from said circular horizontal planar member and an upper edge located adjacent said separation chamber top, said baffle being so oriented on said upper end of said wash and rinse waters inlet tube as to direct said wash and rinse waters issuing therefrom downwardly and in two directions about said annular separation chamber toward said drain water inlet tube.

7. The filter apparatus claimed in claim 5 wherein said upper end of said drain water inlet tube has an arcuate extension with an upper edge adjacent said separation chamber top, said extension being configured to direct drain water issuing from said drain water inlet in a single direction about the majority of said separation chamber to said separation chamber drain water outlet.

8. The filter apparatus claimed in claim 4 wherein said wash and rinse waters outlet means comprises a perforation in said separation chamber top located directly above and substantially coaxial with said drain water inlet tube, a check valve for said drain water inlet tube, said check valve comprising a disc-like member normally closing said upper end of said drain water inlet tube and having a downwardly depending stem located within said drain water inlet tube, said check valve being shiftable upwardly by drain water passing through said drain water inlet tube into said separation chamber to a position wherein it closes said separation chamber wash and rinse waters outlet perforation during a drain operation whereby during wash and rinse operations wash and rinse waters enter said separation chamber via said wash and rinse waters inlet tube and the supernatant wash and rinse waters after sedimentation exit the separation chamber directly to said vat via said wash and rinse waters outlet perforation, said drain water inlet being closed by its check valve, and during a drain operation drain water enters said separation chamber via said drain water inlet tube and exits the separation chamber together with the collected soil via said separation chamber drain water outlet, said wash and rinse water inlet tube being closed by its check valve.

9. The filter apparatus claimed in claim 8 including a baffle mounted on said upper end of said wash and rinse water inlet tube, said baffle comprising a tubular member having an inner diameter such as to just nicely receive the upper end of said wash and rinse waters inlet tube and to be mounted thereon, a circular planar horizontal member having a perforation therein slightly off-center with respect thereto is affixed to the bottom end of said baffle tubular member, said circular horizontal planar member perforation having a diameter equal to said inner diameter of said baffle tubular member and being coaxial therewith, said baffle tubular member having a pair of diametrically opposed vertical lateral flanges extending along and coplanar with a diameter of said circular horizontal planar member and with a diameter of said circular horizontal planar member perforation, said flanges supporting a cylindrical member coaxial with said circular horizontal planar member, said cylindrical member having a lower edge spaced upwardly from said circular horizontal planar member and an upper edge located adjacent said separation chamber top, said baffle being so oriented on said upper end of said wash and rinse waters inlet tube as to direct said wash and rinse waters issuing therefrom downwardly and in two directions about said annular separation chamber toward said drain water inlet tube.

10. The filter apparatus claimed in claim 8 including a valve guide mounted on the upper end of said drain water inlet, said valve guide comprising a horizontal disc-like member having a central opening with a diameter substantially the same as the outer diameter of said drain water inlet tube, a cylindrical sleeve depends from said disc-like memoer and is coaxial therewith, said sleeve having an inner diameter such as to just nicely receive the upper end of said drain water inlet tube, said disc-like member having a vertical arcuate flange on its upper surface extending along about one half the peripheral edge thereof, said disk having a plurality of upstanding posts spaced evenly about the remaining half of its peripheral edge, said flange and said posts extending upwardly to a position adjacent said separation chamber top about said drain water outlet therein and serve as guides for said drain water inlet check valve, said flange being so oriented as to direct drain water issuing from said drain water inlet about the majority of said annular separation chamber to said drain water outlet thereof.

11. The filter apparatus claimed in claim 4 including means in association with the upper end of said wash and rinse waters inlet tube to direct wash and rinse waters issuing therefrom downwardly and in two directions about said annular separation chamber toward said drain water inlet tube and means in association with drain water inlet to direct drain water issuing therefrom in a single direction about said annular separation chamber to said drain water outlet.

12. The filter apparatus claimed in claim 2 wherein said wash and rinse waters inlet of said separation chamber comprises a vertical tube-like structure passing through said bottom of said separation chamber and having a lower end connected to said second pump outlet in water tight fashion and an upper end approaching said top of said separation chamber, said check valve of said wash and rinse waters inlet comprising a disc-like member normally resting on said upper end and closing said upper end of said wash and rinse waters inlet tube with a downwardly depending stem located within said wash and rinse waters inlet tube, said check valve being shiftable upwardly to an open position by wash and rinse waters passing through said wash and rinse waters inlet tube to said separation chamber, said drain water inlet of said separation chamber comprising a tube-like structure passing through said bottom of said separation chamber and having a lower end connected to said third pump outlet in water-tight fashion and an upper end approaching said top of said separation chamber, said drain water inlet tube being located substantially diametrically opposite said wash and rinse waters inlet tube in said separation chamber, said drain water outlet of said separation chamber being located near and to one side of said drain water inlet tube, said drain water outlet comprising a tube-like member depending from said bottom of said separation chamber and having a lower end connectable to drain and an upper end flush with the inside surface of said bottom of said separation chamber.

13. The filter apparatus claimed in claim 12 wherein said drain water inlet tube serves and rinse waters outlet means during said wash and rinse operations, whereby during said wash and rinse operations wash and rinse waters enter said separation chamber via said wash and rinse waters inlet tube and the supernatant wash and rinse waters after sedimentation exit said chamber to said vat via said drain water inlet tube, said pump and said spray means, and during a drain operation drain water enters said separation chamber via said drain water inlet tube, and exits the separation chamber together with the collected soil via said separation chamber drain water outlet, said wash and rinse water inlet tube being closed by its check valve.

14. The filter apparatus claimed in claim 13 including a baffle mounted on said upper end of said wash and rinse water inlet tube, said baffle comprising a tubular member having an inner diameter such as to just nicely receive the upper end of said wash and rinse waters inlet tube and to be mounted thereon, a circular planar horizontal member having a perforation therein slightly off-center with respect thereto is affixed to the bottom end of said baffle tubular member, said circular horizontal planar member perforation having a diameter equal to said inner diameter of said baffle tubular member and being coaxial therewith, said baffle tubular member having a pair of diametrically opposed vertical lateral flanges extending along and coplanar with a diameter of said circular horizontal planar member and with a diameter of said circular horizontal planar member perforation, said flanges supporting a cylindrical member coaxial with said circular horizontal planar member, said cylindrical member having a lower edge spaced upwardly from said circular horizontal planar member and an upper edge located adjacent said separation chamber top, said baffle being so oriented on said upper end of said wash and rinse waters inlet tube as to direct said wash and rinse waters issuing therefrom downwardly and in two directions about said annular separation chamber toward said drain water inlet tube.

15. The filter apparatus claimed in claim 13 wherein said upper end of said drain water inlet tube has an arcuate extension with an upper edge adjacent said separation chamber top, said extension being configured to direct drain water issuing from said drain water inlet in a single direction about the majority of said separation chamber to said separation chamber drain water outlet.

16. The filter apparatus claimed in claim 12 wherein said wash and rinse waters outlet means comprises a perforation in said separation chamber top located directly above and substantially coaxial with said drain water inlet tube, a check valve for said drain water inlet tube, said check valve comprising a disc-like member normally closing said upper end of said drain water inlet tube and having a downwardly depending stem located within said drain water inlet tube, said check valve being shiftable upwardly by drain water passing through said drain water inlet tube into said separation chamber to a position wherein it closes said separation chamber wash and rinse waters outlet perforation during a drain operation whereby during wash and rinse operations wash and rinse waters enter said separation chamber via said wash and rinse waters inlet tube and the supernatant wash and rinse waters after sedimentation exit the separation chamber directly to said vat via said wash and rinse waters outlet perforation, said drain water inlet being closed by its check valve, and during a drain operation drain water enters said separation chamber via said drain water inlet tube and exits the separation chamber together with the collected soil via said separation chamber drain water outlet, said wash and rinse water inlet, tube being closed by its check valve.

17. The filter apparatus claimed in claim 16 including a baffle mounted on said upper end of said wash and rinse water inlet tube, said baffle comprising a tubular member having an inner diameter such as to just nicely receive the upper end of said wash and rinse waters inlet tube and to be mounted thereon, a circular planar horizontal member having a perforation therein slightly off-center with respect thereto is affixed to the bottom end of said baffle tubular member, said circular horizontal planar member perforation having a diameter equal to said inner diameter of said baffle tubular member and being coaxial therewith, said baffle tubular member having a pair of diametrically opposed vertical lateral flanges extending along and coplanar with a diameter of said circular horizontal planar member and with a diameter of said circular horizontal planar member perforation, said flanges supporting a cylindrical member coaxial with said circular horizontal planar member, said cylindrical member having a lower edge spaced upwardly from said circular horizontal planar member and an upper edge located adjacent said separation chamber top, said baffle being so oriented on said upper end of said wash and rinse waters inlet tube as to direct said wash and rinse waters issuing therefrom downwardly and in two directions about said annular separation chamber toward said drain water inlet tube.

18. The filter apparatus claimed in claim 16 including a valve guide mounted on the upper end of said drain water inlet, said valve guide comprising a horizontal disc-like member having a central opening with a diameter substantially the same as the outer diameter of said drain water inlet tube, a cylindrical sleeve depends from said disc-like member and is coaxial therewith, said sleeve having an inner diameter such as to just nicely receive the upper end of said drain water inlet tube, said disc-like member having a vertical arcuate flange on its upper surface extending along about one half the peripheral edge thereof, said disk having a plurality of upstanding posts spaced evenly about the remaining half of its peripheral edge, said flange and said posts extending upwardly to a position adjacent said separation chamber top about said drain water outlet therein and serve as guides for said drain water inlet check valve, said flange being so oriented as to direct drain water issuing from said drain water inlet about the majority of said annular separation chamber to said drain water outlet thereof.

19. The filter apparatus claimed in claim 12 including means in association with the upper end of said wash and rinse waters inlet tube to direct wash and rinse waters issuing therefrom downwardly and in two directions about said annular separation chamber toward said drain water inlet tube and means in association with said drain water inlet to direct drain water issuing therefrom in a single direction about said annular separation chamber to said drain water outlet.

* * * * *